US006659097B1

(12) United States Patent
Houston

(10) Patent No.: US 6,659,097 B1
(45) Date of Patent: Dec. 9, 2003

(54) CUSTOM MANUFACTURE OF TILES FOR USE WITH PREEXISTING MASS-MANUFACTURED TILES

(76) Inventor: Daniel J. Houston, 2409 Calle Soria, Santa Barbara, CA (US) 93109

( * ) Notice: Subject to any disclaimer, the term of this patent is extended or adjusted under 35 U.S.C. 154(b) by 231 days.

(21) Appl. No.: 09/955,697

(22) Filed: Sep. 19, 2001

Related U.S. Application Data

(60) Provisional application No. 60/234,820, filed on Sep. 22, 2000.

(51) Int. Cl.[7] ..... B28D 1/02

(52) U.S. Cl. ..... 125/12; 29/401.1; 52/311.1; 52/385

(58) Field of Search ..... 125/1, 12; 29/401.1, 29/402.03, 402.08, 402.09, 402.11; 52/384–392, 311.1, 311.3

(56) References Cited

U.S. PATENT DOCUMENTS

| | | | | |
|---|---|---|---|---|
| 1,767,081 A | | 6/1930 | Körber | |
| 3,740,913 A | | 6/1973 | Musser | |
| 3,875,716 A | * | 4/1975 | Eusemann | 52/311.2 |
| 4,133,152 A | | 1/1979 | Penrose | |
| 4,242,390 A | | 12/1980 | Nemeth | |
| 4,599,254 A | | 7/1986 | Cuttica | |
| 4,828,542 A | * | 5/1989 | Hermann | 156/268 |
| 5,406,763 A | | 4/1995 | Al-Saleh | |
| 5,568,391 A | | 10/1996 | Mckee | |

FOREIGN PATENT DOCUMENTS

EP 0 864 405 A2 9/1998

* cited by examiner

*Primary Examiner*—Timothy V. Eley
(74) *Attorney, Agent, or Firm*—Craig A. Fieschko, Esq.; DeWitt Ross & Stevens S.C.

(57) ABSTRACT

A decorative tile set of nonuniformly-shaped tiles (tiles with non-parallel sides and/or non-perpendicular comers) is manufactured for interlocking installation adjacent uniformly-shaped tiles, i.e., adjacent to tiles having parallel sides and/or perpendicular corners, as in standard flooring tiles such as laminate flooring planks. A sacrificial bed having a planar upper bed surface is provided, and trenches are cut in the sacrificial bed to define areas on the upper bed surface which at least substantially correspond to tile boundaries. At least one workpiece from which the tiles are to be cut is then provided atop the sacrificial bed with its finished face closely held against the sacrificial bed. The workpiece is then cut to produce tile blanks bounded by tile blank boundaries, with the tile blank boundaries being outwardly spaced from the desired tile boundaries by an offset distance. The tile blanks are then cut to produce the tiles by forming either male or female interlocking structure on selected tile blanks. Any male interlocking structure (such as a tongue) is defined in the offset regions of the tile blanks, while any female interlocking structure (such as a groove) is defined in portions of the tile blanks within their tile boundaries and their offset regions. The tiles within the tile set may then be installed simultaneously with the installation of the uniformly-shaped tiles, or may instead be installed as an insert within preinstalled uniformly-shaped tiles, as by removing selected uniformly-shaped tiles and inserting the tile set within the space previously occupied by the selected uniformly-shaped tiles.

20 Claims, 4 Drawing Sheets

CUSTOM MANUFACTURE OF TILES FOR USE WITH PREEXISTING MASS-MANUFACTURED TILES

CROSS-REFERENCE TO RELATED APPLICATIONS

This application claims priority under 35 USC § 119(e) to U.S. Provisional Patent Application No. 60/234,820 filed Sep. 22, 2000, the entirety of which is incorporated by reference herein.

FIELD OF THE INVENTION

This disclosure concerns an invention relating generally to the manufacture of tiles for floors, walls, and other surfaces, and more specifically to the custom manufacture of such tiles for use in conjunction with preexisting mass-manufactured tiles.

BACKGROUND OF THE INVENTION

Laminate (more commonly known as plastic laminate) is a product which has been used in this country for decades as a countertop surface or a veneer for numerous articles of furniture, cabinetry and other architectural features. Laminate flooring (also known as plastic laminate flooring) was first introduced in the United States around 1994 by the Swedish company Pergo AB. Its initial product line consisted of planks made of laminated wood which were approximately 8" wide and 48" long, and which came in an assortment of wood tone finishes. Since that time, many other companies (such as Formica Corporation and Wilsonart International) have manufactured plastic laminate, and it is now an exceedingly popular floor covering.

Laminate flooring consists of layers of different materials, generally wood and/or wood byproducts/composites, which include an upper plastic laminate layer. The plastic laminate layer can be made to look like materials such as wood, stone, marble and cork by various printing methods. The specific finish that the floor is to replicate is printed on a layer which is incorporated into the plastic laminate. The plastic laminate is then adhered to a substrate of wooden or wooden composite material. To make the finished surface durable, a tough wear layer is applied to the laminate surface.

Typically, the wear layer, laminate layer and substrate layer are produced in 4' by 8' sheets in a linear production line prior to their being resized into elongated plank-like flooring tiles. A sheet moves along a conveyor to different stations to be cut to the rough shape and size of the tiles. The sheet is often first cross-cut to produce two 4' by 4' sections, and is then gang-ripped to produce planks. The planks continue along the conveyor and are fed into a molder, which has a series of cutters set in a straight line array in order to profile a tongue along one side edge of the plank and a groove along the opposite side edge of the plank. The pieces are then rotated by means of the conveyor and are fed into the next machine, which adds a tongue to one end edge of the plank and a groove to the opposite end edge of the plank. The resulting planks are then suitable for installation on a floor (or other surface) by fitting a tongue of one plank into the groove of an adjacent plank.

Wood flooring is manufactured in much the same way, but solid wood flooring is generally not initially cut into standard-size larger sheets. Rather, it is milled into board widths determined by the girth of the tree from which they came. Engineered wood flooring is more similar to laminate flooring in that a surface layer or veneer of a wood species is adhered to a substrate of either plywood or a composite material, and such engineered wood flooring may be initially laid up in the 4' by 8' format. The machining process for engineered wood flooring is generally similar to that for laminate and wood flooring.

Manufacturing of the aforementioned tiles requires a surprising degree of precision. Tile thicknesses are of critical concern, since tiles that have out-of-tolerance thicknesses, or vertically offset tongues or grooves, generate "ledging": one tile has an edge raised above the surface of an adjacent tile. Apart from being unsightly and potentially dangerous (particularly since upper wear surfaces are generally very tough and can provide a knife-like edge), ledging leads to rapid wear. This is why a tongue and groove or similar interlocking arrangement (such as splines, rabbeted joints, or embedded metal interlocks) is generally needed between laminate tiles; the interlocking arrangement, if properly situated on the tile edges, helps align the top surfaces of laminate tiles in coplanar relationship, even if adhesive is not uniformly applied to the bottoms of adjacent tiles. Additionally, since gaps between adjacent tiles can greatly diminish the appearance of the floor, tight dimensional tolerances must be observed in tile lengths and widths. Prefinished materials such as plastic laminate and wood veneers require a very tight tolerance, whereas installations that are sanded and finished—such as with wooden floors—the filler and finish help disguise any gaps related to milling (as well as gaps arising from swelling or contraction). Additionally, any ledging is removed through the sanding process.

An exception to the foregoing forms of manufacturing occurs with decorative elements, such as medallions and feature strips (also known as border strips), for wooden flooring. A medallion may include a predetermined design made up of differently shaped pieces of different types of wood. The pieces of the design are machined from thin layers of wood (usually no more than ⅛" thick) with their edges perpendicular to the top and bottom surfaces so that they can be adjacently fitted together with no gaps. The pieces are adhered to a substrate which is then cut to the required shape, such as a square, rectangle, circle or ellipse. Thus, medallions are veneered tiles somewhat similar to engineered wood tiles, and the design pieces serve as a decorative top layer for the substrate. Borders are manufactured similarly, but generally use only squares and rectangles for their design pieces. Additionally, borders may include a tongue and groove edge to allow the linear mode of manufacturing. Medallions often do not have a tongue or groove around their edge, and can only be installed as a drop-in feature. In other words, after an entire floor has been installed, a hole can be cut through the installed floor (generally with a router) to accept the medallion, which is then glued in place. Decorative elements are mass produced, and various lines of elements are available in stores and catalogs for installation in wooden floors.

As of 2001, decorative elements such as borders and medallions are not known to be used with laminate floors. This is probably owing to several reasons. First, because they are made of different materials than the laminate floors (generally wood or wooden composites), their different appearance is difficult to coordinate with laminates, particularly if their finish changes with age. Second, since the laminates are much tougher, the more significant wear on the wood-based elements would make them stand out more over time. Third, laminates must be cut with great care so that their surfaces do not chip, or so that the laminate planks do not break (which may occur if hole-cutting unduly reduces the width of a laminate plank). This makes it inadvisable to cut holes in laminates to receive decorative elements, since chipping of the laminate floor may necessitate its removal and replacement if damage occurs. Fourth, laminates can be difficult to cut with precision owing to their toughness, making it difficult to cut a hole in a laminate floor which may tightly receive a decorative element. Fifth, unless a decorative element is made of laminate materials—which is exceedingly difficult for the aforementioned reasons—the use of a decorative element with laminate floors can lead to gapping and ledging problems owing to different degrees of expansion/contraction between the materials owing to heat and humidity. Sixth, since the thicknesses of laminate floors vary by manufacturer, it would be exceedingly expensive to manufacture decorative elements for all different laminate flooring lines because of the wide variety of decorative elements that would be required. Variations in the widths and lengths of laminate planks generate similar difficulties. It is possible to create a border of sorts for laminate floors by using differently-colored planks (from the same manufacturer) adjacent the walls and bounding the remainder of the floor, but since such borders are uniformly colored—as opposed to commonly-used variegated border designs, such as checked and mosaic designs—these are rather drab. It is inadvisable to merely cut laminate planks into sections and arrange them into patterns, since the cutting will almost certainly eliminate some or all of the tongue-and-groove engagements between sections, and the interlocking arrangement between sections is needed to help avoid ledging and gaps. Additionally, the aforementioned cameras with chipping and/or gaps arise.

It would therefore be useful to have available methods and apparata for producing decorative elements suitable for use with laminate floors, in particular decorative elements made of laminate material, which avoid or substantially reduce the aforementioned problems.

SUMMARY OF THE INVENTION

The invention involves a method of custom manufacture of tiles which may be used in conjunction with preexisting mass-manufactured tiles (such as planks of laminate flooring), with the invention being intended to at least partially solve the aforementioned problems. To give the reader a basic understanding of some of the advantageous features of the invention, following is a brief summary of preferred versions of the method. As this is merely a summary, it should be understood that more details regarding the preferred versions may be found in the Detailed Description set forth elsewhere in this document. The claims set forth at the end of this document then define the various versions of the invention in which exclusive rights are secured.

In a particularly preferred version of the invention, a decorative tile set of nonuniformly-shaped tiles (tiles with non-parallel sides and/or non-perpendicular corners) is manufactured for interlocking installation adjacent uniformly-shaped tiles, i.e., adjacent to tiles having parallel sides and/or perpendicular corners, as in standard flooring tiles such as laminate flooring planks. By "interlocking installation", this document refers to installation wherein at least a portion of one tile edge is complementarily interfit with the edge of an adjacent tile. Initially, the decorative tile set and each tile therein are defined. For each tile, a tile boundary at the upper surface of the tile is defined wherein the tiles within the tile set are adjacently situated at the tile boundaries. A tile blank boundary is then defined about each tile boundary at the upper surface of the tile by adding an offset region to the tile boundary in one or more directions parallel to the upper surface of the tile.

The invention then makes use of an advantageous means for cutting the defined tiles in the tile set. A sacrificial bed having a planar upper bed surface is provided, and trenches are cut in the sacrificial bed to define areas on the upper bed surface which at least substantially correspond to the tile boundaries. A workpiece from which the tiles within the tile set are to be cut is then provided atop the sacrificial bed. The workpiece has an upper surface corresponding to the upper surfaces of the tiles in the tile set. Preferably, the upper surface of the workpiece is situated in abutment with the sacrificial bed and is secured to the sacrificial bed, as by applying a vacuum from the sacrificial bed. This may be done, for example, by applying a vacuum force to the workpiece from the sacrificial bed, as by making the sacrificial bed porous or otherwise providing apertures in it from which a vacuum force may reach the workpiece (with the vacuum force perhaps being provided by the machine bed of the cutting tool).

The workpiece is then cut to produce tile blanks bounded by the tile blank boundaries. The tile blanks are cut to produce the tiles by forming either male or female interlocking structure on selected tile blanks, with such cutting removing any offset regions to leave tiles bounded at their upper surfaces by the defined tile boundaries. Any male interlocking structure (such as a tongue) is defined in portions of the tile blanks beneath their offset regions, i.e., within the tile blank boundaries and outside the tile boundaries. Any female interlocking structure (such as a groove) is defined in portions of the tile blanks beneath their tile boundaries and their offset regions, i.e., within their tile blank boundaries and their tile boundaries. The cutting of the interlocking structure on each tile blank removes the tile blank's offset region to conform the tile blank's upper surface to correspond to the tile boundaries therein.

This cutting of the male and female interlocking structure is advantageously performed by a cutting tool which extends through the planes of the tile blanks and into the trenches of the sacrificial bed. Where the upper surfaces of the tile blanks (and thus the tiles) are held against the sacrificial bed, the holding force helps to maintain the integrity of the upper (finished) surfaces as the cutting tool cuts into them, thereby helping to avoid chipping or other damage to the upper surfaces. In effect, the sacrificial bed reinforces the upper surfaces and helps to protect them in regions within the tile boundaries. Since the cutting tool extends within the planes of the tile blanks and beyond (into the trenches in the sacrificial bed) during cutting, the cutting tool surfaces that provide the cutting are spaced from the tip of the cutting tool (which rests within the trenches), thereby decreasing the likelihood that any flexure in the cutting tool will give rise to imprecision in cutting at the tile blank upper surfaces, decreasing the possibility of gapping between the produced tiles. Beneficially, the foregoing arrangement allows the rapid and inexpensive manufacture of irregularly-shaped tiles with small-radius curves, sharp corners, and other features that would ordinarily be extremely difficult to form in laminate tiles without chipping or breaking, particularly where tongues and/or grooves are also provided near these features.

The tiles within the tile set may then be installed at the same time as the uniformly-shaped tiles, or may instead be installed as an insert within preinstalled uniformly-shaped tiles, as by removing selected uniformly-shaped tiles and inserting the tile set within the space previously occupied by the selected uniformly-shaped tiles.

The invention therefore offers a significant addition to the flooring industry by allowing the manufacture and use of durable decorative tile sets which may be made of the same materials as the floor wherein the decorative tile sets are to be installed, and which may be made to interlock with the floor materials, thereby avoiding irregular appearance/wear and gapping/ledging problems. Since the decorative tile sets may be produced for installation with the preexisting interlocking structure of the surrounding floor (i.e., the surrounding tongues/grooves or other structure), they may be installed alongside the surrounding floor tiles or may be retrofit in the surrounding floor tile with the removal of surrounding floor tile. Additionally, since the decorative tile sets may be made from the same materials as the surrounding floor—i.e., they may be made from materials having the same thicknesses and characteristics, from the same manufacturer, and may even be formed from tiles taken from the surrounding floor—gapping and ledging can be greatly reduced.

Further advantages, features, and objects of the invention will be apparent from the following detailed description of the invention in conjunction with the associated drawings.

DETAILED DESCRIPTION OF PREFERRED EMBODIMENT OF THE INVENTION

Figure 1:
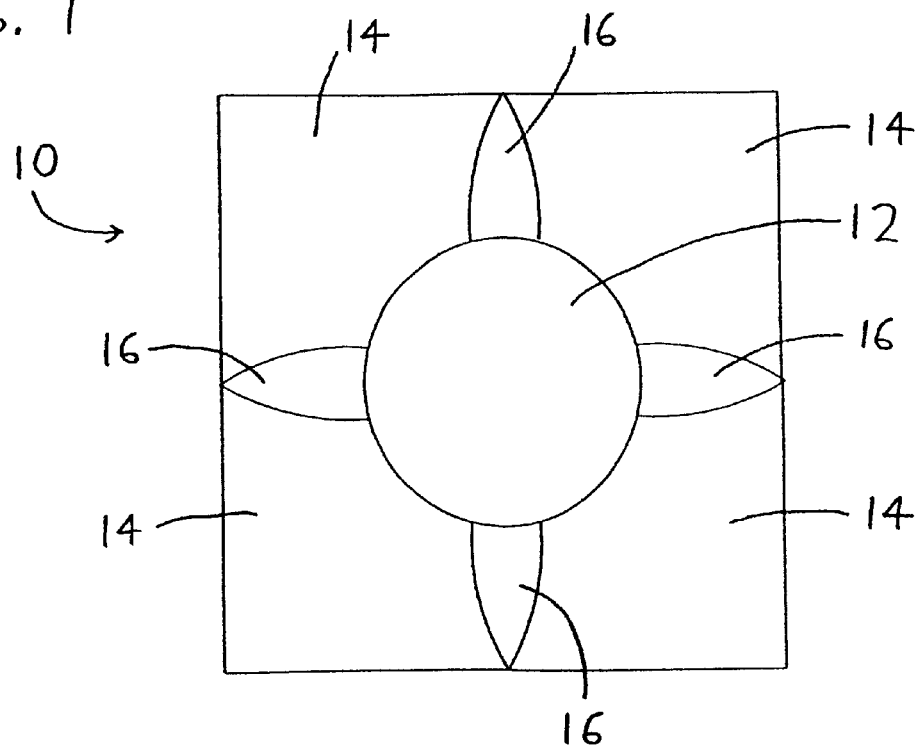
FIG. 1 is a top plan view of a proposed decorative tile set 10 for installation within standard floor tiles, e.g., standard laminate planks, showing the tile boundaries of tiles 12, 14, and 16.

One version of the invention will now be described with reference to FIGS. 1–6, which illustrate preferred steps used to manufacture a decorative tile set for use in conjunction with standard laminate flooring. Referring particularly to FIG. 1, a user first prepares a design for the decorative tile set. FIG. 1 illustrates an exemplary tile set design 10 having nine tiles therein. While the overall tile set design 10 has a square boundary, thereby making it readily fittable alongside standard preexisting laminate flooring planks, the boundaries of the individual tiles within the design have an irregular shape (with "irregular" here meaning that the tiles include non-perpendicular angles and/or non-parallel sides), including a central medallion 12, corner pieces 14, and intermediate pieces 16. Most preferably, the tile set design 10 is prepared on standard computer aided design (CAD) software. The tile set design 10 represents only the boundaries of the tile set and its individual tiles at their upper surfaces, and does not include any tongues or grooves to be included on the tiles.

Figure 2:
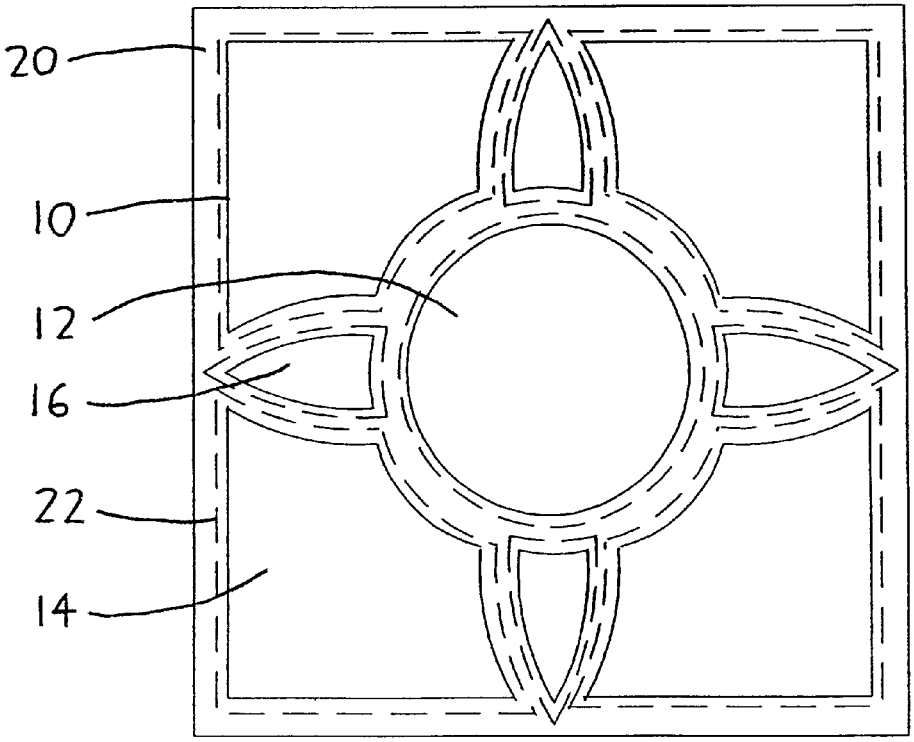
FIG. 2 is a top plan view of the decorative tile set of FIG. 1 shown laid out over a proposed workpiece, illustrating addition of offset regions to the tile boundaries to define tile blanks 22.

Referring then to FIG. 2, the tile set design 10 is then laid out (preferably "virtually", e.g., in a computer model) on a workpiece 20 from which the tiles will be cut. Since the tiles in the tile set design 10 may have tongues protruding from their edges after cutting, the tiles should be spaced apart on the workpiece 20, e.g., all tiles could be spaced from each other by at least two tongue lengths plus the width of a standard cutting head (thereby ensuring that a cutting head can fit between two tiles laid out on the workpiece 20 and cut tongues on their adjacent edges). This is depicted by the phantom lines in FIG. 2, wherein the phantom line boundaries 22 surrounding each tile represent the dimensions of each tile at its top surface, plus an offset distance equal to a tongue length (or more preferably an offset distance slightly greater than a tongue length to leave some excess material for removal by a fine or finishing cutter). The offset regions bounded by the phantom lines 22 can therefore be regarded as defining tile blanks: if the tile blanks 22 were cut from the workpiece 20, each tile blank would have at least enough material present to allow formation of the tile with tongues on all sides. The workpiece is preferably a standard 4' by 4' or 4' by 8' piece of the laminate flooring stock from which the finished pieces will be cut. Other arrangements are also possible; for example, where wooden tiles are desired, an individual workpiece 20 could be used for each tile, or several pieces of wood could be glued together to form a workpiece 20 suitable to the size of a particular tile (and similarly, several standard laminate planks could be adhered together to form a workpiece 20). It is noted that while the illustrated tile set design 10 is overall square, and is thus well suited for placement on the illustrated square workpiece by merely spreading its tiles 10, 12, and 14, other tile set designs may have their tiles rotated, moved in relative position, or otherwise rearranged on the workpiece 20 (preferably in such a manner that waste from the workpiece 20 would be minimized after the tiles are cut from the workpiece 20).

Figure 3:
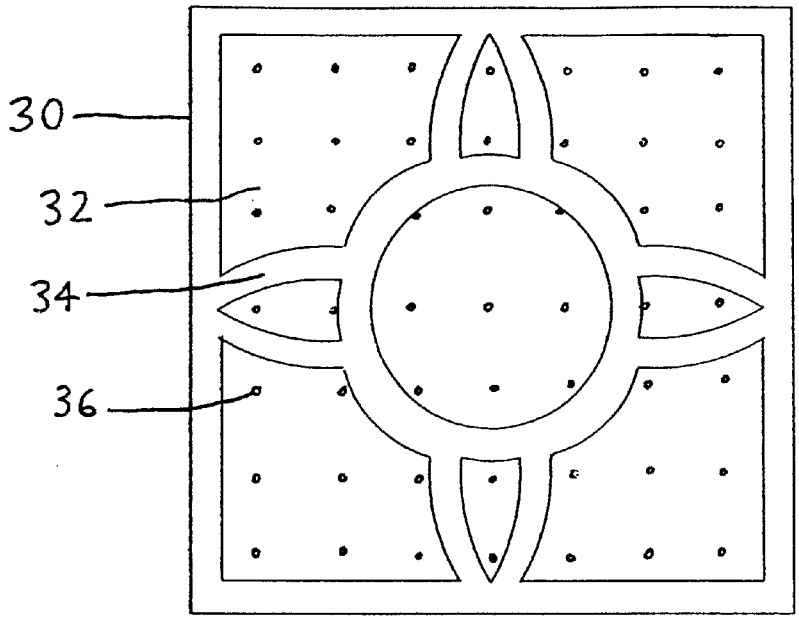
FIG. 3 is a top plan view of a sacrificial bed 30 to be used in conjunction with the cutting of tiles from the workpiece of FIG. 2.

Once the relative positions of the tile boundaries, tile blank boundaries, and workpiece are determined, a sacrificial bed 30 is created for use during the later steps of actually cutting the tiles. The sacrificial bed 30 is preferably sized and configured similarly to the workpiece from which the tiles will be cut, and it has a planar upper bed surface 32, and preferably includes some form of holding means for firmly maintaining the workpiece (and thus the tiles cut therefrom) against the upper bed surface 32 during cutting of the tiles (preferably with the top surfaces of the tiles contacting the upper bed surface 32). As illustrated in FIG. 3, trenches 34 are cut into the upper bed surface 32 to leave areas on the upper bed surface 32 which correspond to the tile boundaries. As a result, when the workpiece is set against the upper bed surface 32, the trenches 34 will rest below. The benefit of the trenches 34 is that when the tiles are later cut from the workpiece, a cutting tool (such as a router bit) which has a length much greater than the thickness of the workpiece may be used, and may be extended through the workpiece and into the trenches 34 of the sacrificial bed 30 during cutting. Thus, the entire thickness of the workpiece may be guaranteed to contact the length of the cutting tool.

The cutting of the trenches 34 is preferably done by a computer numeric controlled (CNC) cutter/router. A typical CNC router incorporates a bed that moves in the Y (horizontal) axis and a router that moves in the X (horizontal) and Z (vertical) axes, with motions being controlled through the use of servomotors. If CAD software is used for the foregoing tile set design steps, the CAD software may be able to directly translate the tile boundaries into cutting instructions for the CNC cutter. Advantageously, standard CAD-to-CNC software will generate CNC instructions with minimal need for user input, and can even automatically determine parameters such as the identification of the cutters to be used, the diameter of the cutters, the height of the cutters, the rpm of the cutters, and the feed rate of the cutters. The programming software will generally identify each boundary of each tile blank and/or tile and automatically create an offset or series of offsets relative to the diameters of the cutters. Typical CAD software packages include the ability to create cutting instructions with dimensional tolerances up to eight decimal places. Most current flooring tolerances do not exceed three decimal places, a standard accepted by many industries.

Prior to or after cutting trenches 34 in the sacrificial bed 30, it is also useful to mill the entire upper bed surface 32 so that it rests at a certain known location along the Z (vertical) axis. This will help to better insure the accurate location of Z-axis coordinates on the workpiece when it is later set atop the sacrificial bed 30.

As noted above, the sacrificial bed 30 supports the workpiece during later cutting of the tile blanks and tiles from the workpiece. While the use of the sacrificial bed 30 is not strictly necessary, it is believed to result in cutting of the tile blanks and tiles more closely to desired tolerances. Use of the sacrificial bed 30 is believed to be particularly advantageous where the upper surface of the workpiece (and thus the upper surfaces of the tile blanks and tiles) rests in contact with the upper surface of the sacrificial bed 30. In this case, the tile upper surfaces—which are the surfaces which are displayed when the tiles are in use, and which are most desirably preserved from damage—are believed to better avoid chipping when the cutting tool moves across this layer of the workpiece and sacrificial bed 30. As an example, it is often worrisome to cut across the tough upper surfaces of laminate workpieces (often made of aluminum oxide compositions) owing to the possibility of chipping the upper surfaces, but where the upper bed surface 32 of the sacrificial bed 30 supports the upper workpiece surface/tile surface, such chipping is believed to be greatly reduced or eliminated.

A preferred form of holding means for maintaining the workpiece against the sacrificial bed 30 is a vacuum force exerted by the sacrificial bed 30 onto the workpiece, though other holding means such as clamps, fasteners, adhesives, or any other appropriate holding means may be used. The vacuum force may be provided from apertures 36 in the sacrificial bed 30 leading to a vacuum supply, and in the most preferred version of the invention, the cutting tool used to cut the sacrificial bed 30 and workpiece—a CNC router—includes a machine bed with a vacuum supply. The sacrificial bed 30 is then made of porous material, such as low-density fiberboard, so that when the sacrificial bed 30 is placed atop the machine bed, the vacuum supplied to the sacrificial bed 30 holds the sacrificial bed 30 down, but the vacuum is also transmitted through the sacrificial bed 30 to any object (such as the workpiece) which may be resting atop it.

Every time a workpiece having a new tile set layout is to be cut, a new sacrificial board must be prepared with trenches 34 corresponding to the new layout of the tile boundaries on the workpiece. If a run of numerous tile sets having the same layout is prepared, the same sacrificial bed 30 may be used for all of the tile sets in the run. It is notable that once a sacrificial bed 30 is prepared, a user need not place a workpiece atop the entire sacrificial bed 30; instead, he or she may simply place pieces of workpiece material atop each of the raised areas of the upper bed surface 32 (those surrounded by the trenches 34), preferably with the pieces overhanging the areas of the raised upper bed surfaces 32 by a distance at least as great as the offset distance. The invention will then cut these pieces into the tiles desired. So long as the pieces of workpiece material are sized at least as large as the areas of the raised upper bed surfaces 32, they may produce useful tiles, though they may have reduced-size tongues (or may even lack tongues) if they do not overhang the raised upper bed surfaces 32 by a distance at least as great as the offset distance.

Figure 4:
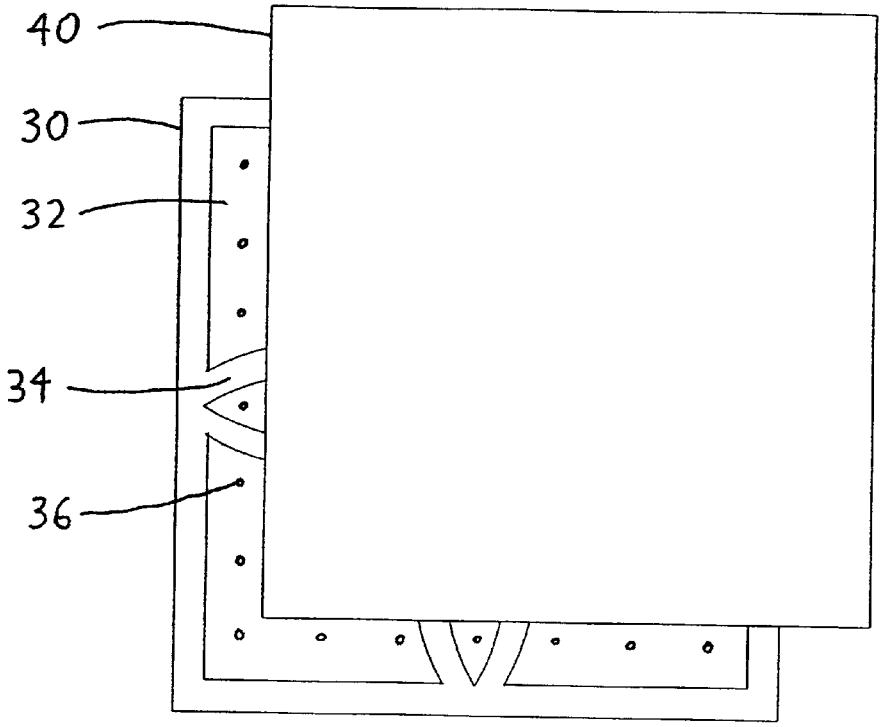
FIG. 4 provides a top plan view of a workpiece 40 from which the tiles are to be cut, shown offset from the sacrificial bed 30 of FIG. 3. It should be understood that the offset is provided to enhance visibility and understanding, and ordinarily the entirety of the workpiece (or as much as possible of the workpiece) would be set atop the upper bed surface 32.

FIG. 4 then illustrates the placement of a workpiece 40 atop the upper bed surface 32 of the sacrificial bed 30. Note that the workpiece 40 is shown offset from the sacrificial bed 30 to enhance the reader's view and understanding of the arrangement, but it should be understood that the entirety of the workpiece 40, or as much as possible of the workpiece 40, would ordinarily be set atop the upper bed surface 32. As noted previously, this is most preferably done with the top (finished) surface of the workpiece 40 (and thus the top surfaces of the tile blanks and tiles produced therefrom) in contact with the upper bed surface 32. Maintaining the finished surface of the tile blanks and tiles against the sacrificial bed 30 is believed useful to avoid chipping. Later cutting of tiles from the workpiece 40 is preferably done with reference to a z axis defined relative to the upper bed surface 32, and/or to the finished surface of the workpiece 40 (and thus the tile blanks and tiles), so that any tongues or grooves cut from the tile blanks will be cut relative to what will later be the finished surfaces of the tiles, thereby diminishing the possibility of ledging. The holding means (e.g., the vacuum apertures 36) is then used to tightly maintain the workpiece 40 relative to the machine bed, sacrificial bed 30, and cutting tool.

Figure 5:
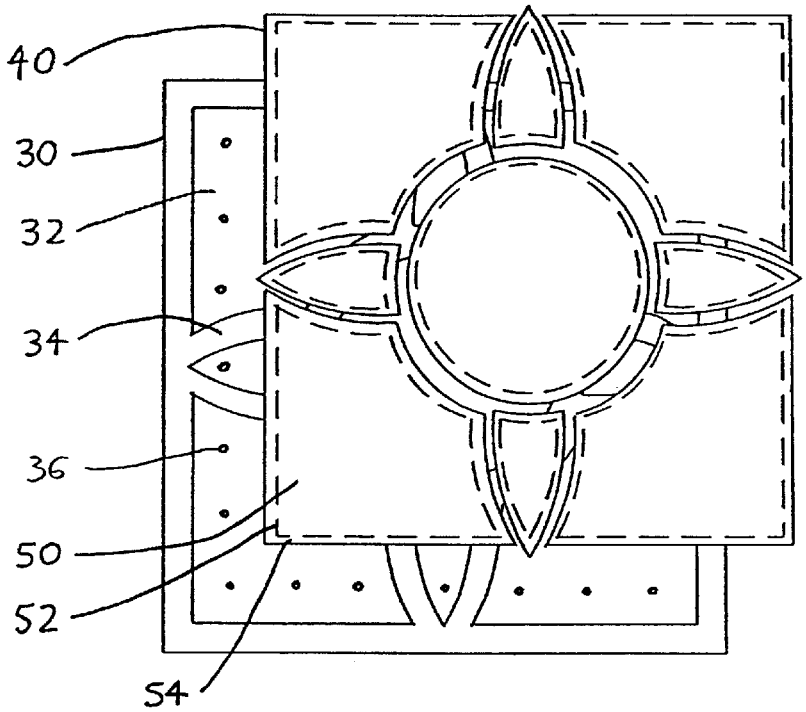
FIG. 5 is a top plan view corresponding to FIG. 4 wherein workpiece material has been cut away from the workpiece 40 to leave tile blanks 50, the tile blanks having tile blank boundaries spaced from the desired tile boundaries 52 by offset regions 54.

The cutting tool then cuts through the workpiece 40 to extend into the trenches 34 in the sacrificial bed 30, and is moved about the workpiece 40 in paths corresponding to the tile blank boundaries (i.e., the tile boundaries plus the offset regions) to cut tile blanks from the workpiece 40. The resulting tile blanks are shown in FIG. 5, wherein the tile blanks 50 are shown above the sacrificial bed 30 (again offset to enhance visibility and understanding), and with the tile boundaries 52 shown in phantom lines atop the tile blanks 50.

Figure 6:
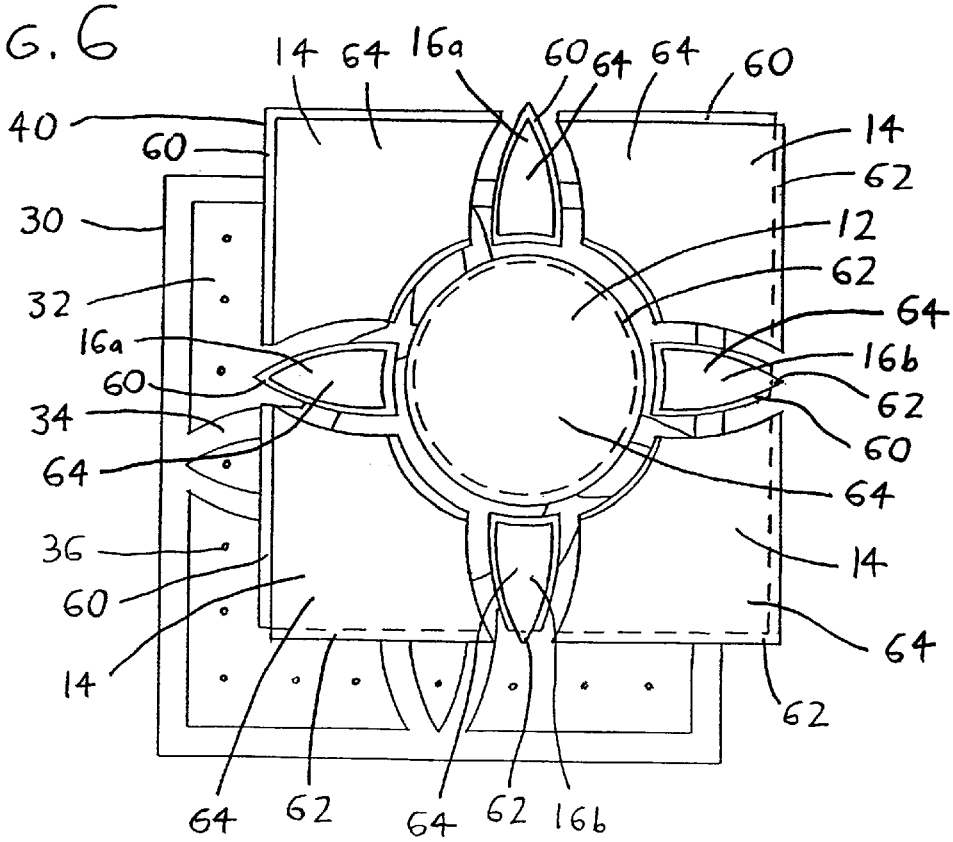
FIG. 6 is a top plan view corresponding to FIG. 5 wherein the offset regions of the tile blanks are cut away to leave tiles bounded at their upper surfaces by tile boundaries, and having tongues extending from their edges and/or grooves defined within their edges.

The same or a different cutting tool (generally a different one) is then used to cut male and female interlocking structure—such as tongues and grooves, splines, or rabbets and joints—into all or portions of the edges of the tile blanks 50. When male interlocking structure is cut on a portion of a tile blank 50, portions of its offset region 54 (the region between the tile boundaries 52 and the surrounding edges of the tile blanks 50) are cut away to define a protrusion, such as a tongue, which extends outwardly from the tile boundary in a plane below the top surface of the tile blank 50. This is best illustrated by the intermediate pieces 16*a* in FIG. 6, which have tongues 60 extending about their entire peripheries. When female interlocking structure is cut into a tile blank 50, the tile blank's offset region 54 is eliminated and a concavity (complementary to the male protrusion) is cut into the tile blank 50 beneath its top surface and within the tile boundary 52. This is best illustrated by the medallion 12 in FIG. 6, which has a groove 62 extending about its entire periphery (with the phantom lines in FIG. 6 representing hidden lines beneath the upper surface of the tiles). See also the intermediate pieces 16*b*, which have small grooved portions 62 between their tongued portions 60, and the corner pieces 14, which each illustrate a different tongue and groove arrangement in accordance with the requirements needed to mate the corner pieces 14 with conventional laminate flooring planks at their sides, and to mate them with the intermediate pieces 16*a* and 16*b* and the medallion 12. It is noted that the CAD and/or CNC software may be made to automatically identify where to cut male and female interlocking structure; once the mating requirements for the outside boundaries of the tile set are specified by the user (i.e., where it must have male and female interlocking structure to engage the adjoining standard flooring), an algorithm may be used whereby no adjoining tile boundaries can be assigned the same type of interlocking structure.

Figure 7:
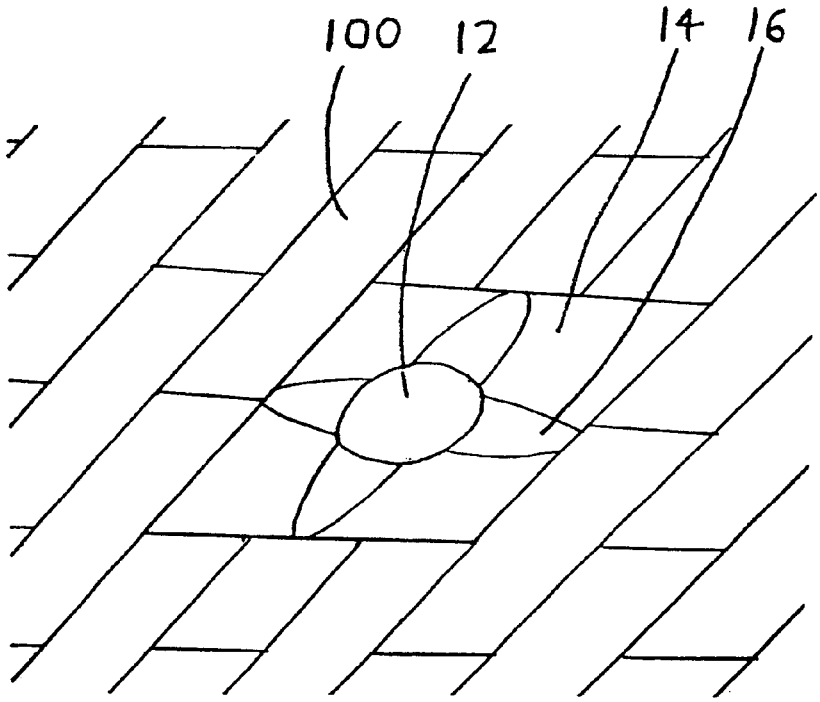
FIG. 7 is a partial perspective view of the tile set of the foregoing Figures shown installed alongside standard floor tiles, e.g., standard laminate planks.

The resulting tiles 12, 14, and 16 may then be removed from the sacrificial bed 30 and installed in a floor alongside standard floor planks 100, as illustrated in FIG. 7. The foregoing steps allow the tiles to be formed with very high precision, and thus the tiles exhibit little or no gapping or ledging.

Generally, a CNC router used to practice the invention would have a tool turret bearing several different types of cutting tools, and several different tools would be used during the machining process. To illustrate the foregoing steps in greater detail with reference to FIG. 5, CNC programming instructions might first instruct the router to retrieve the straight edge cutter that is used to rough cut the tile blanks 50 from the workpiece 40. The instructions would also instruct the router where the cutter should engage the workpiece 40 for the start of the first cut, where to disengage the cutter and move to the starting point of the second cut, and so on. After all of the tile blanks 50 have been rough cut, the program would halt so that the operator can remove any waste material between the tile blanks 50.

Referring to FIG. 6, the programming instructions may then return the straight edge rough cutter to the tool turret and retrieve the cutter for either the male or female interlocking structure. If the male cutter is retrieved first, then all of the edges of the tile blanks 50 to receive a male structure 60 would have the male structure 60 machined at the desired location along the Z axis (as well as the XY directions parallel to the plane of the tile blank 50 top surface). The router then returns the male cutter to the turret and retrieves the cutter for the female interlock. All of the edges of the tile blanks 50 to receive a female structure 62 then have the female structure 62 machined at the desired location. Once all of the tiles 64 have been cut from the tile blanks 50, the tiles 64 can be removed for installation. A new workpiece 40 or workpieces can be placed onto the sacrificial bed 30 if further tiles of the same configuration are to be cut, or a new sacrificial bed 30 having a different arrangement of tiles can be placed onto the router machine bed the whole machining process can begin again. A significant advantage of the invention is that it allows the rapid and inexpensive production of custom decorative tile sets for use in conjunction with common laminate floor planks, and in fact it may use such laminate planks as the workpiece(s) 40 from which it produces the tile sets.

Note that the foregoing description generally refers to cutting of a complete tile set from the same workpiece, thus producing tiles which have the same or a similar finish. Since the method produces tiles which complementarily fit to each other and to adjacent standard floor planks with high precision (with little or no gapping or ledging), an installed tile set with tiles having the same finish is often not very noticeable; it does not stand out from the surrounding tiles. Thus, it is more desirable to have a tile set wherein the tiles have a variety of different finishes—for example, in FIG. 1, tile 12 may have an oak finish, tile 14 a walnut finish, and tile 16 a cherry finish. Since such an arrangement generally cannot be produced from the same workpiece 40 (which will generally have only a single finish), it is contemplated that tile sets may often be produced 25 from multiple workpieces. For example, the tile set 10 may be produced three times, once from a workpiece 40 having an oak finish, once from a workpiece 40 having a walnut finish, and once from a workpiece 40 having a cherry finish, thereby producing tiles sufficient to allow three tile sets 10 to be assembled with different finish combinations. Alternatively, multiple smaller workpieces 40 having different finishes may each be situated atop the raised tile blank areas defined on the sacrificial bed 30, and each may in turn be cut into a tile blank (and then into a tile) in the manner previously discussed.

Additionally, the foregoing discussion and drawings related to a tile set having parallel sides extending between perpendicular corners, and such a tile set is easily installed alongside or within standard laminate flooring (which also has parallel sides and perpendicular corners). However, the invention is readily adapted to accommodate tile sets having irregular shapes as well; for example, consider the case where the desired tile set consists merely of the central medallion 12 and intermediate pieces 16 of FIG. 1. In this case, the corner pieces 14 may be produced from the same laminate flooring material as the standard laminate flooring planks adjacent which the tile set will be installed. The corner pieces 14 might even be formed from one or more standard planks of the laminate flooring material. Thus, when the central medallion 12, corner pieces 14, and intermediate pieces 16 are installed in a standard laminate floor, the central medallion 12 and intermediate pieces 16 will stand out (provided they are made of a different material or differently-colored material), and the corner pieces 14 will blend into the surrounding floor.

The invention is also suitable for producing tile sets having no interlocking structure, though these tile sets are not preferred owing to their lack of structural integrity. It is noted that the tiles within tile sets need not include male and/or female interlocking structures on all of their edges, nor need they have such structures extend across the entireties of the edges where the interlocking structures are included. For example, rather than having a tongue extending across an entire edge of a tile, the edge may have one or more short tongues or "teeth" on that edge. An adjacent tile edge may then have a groove defined across only a portion of its length; another adjacent tile edge might omit both tongues and grooves, and may merely present a smooth edge; and so forth.

The invention is not intended to be limited to the preferred version described above, but rather is intended to be limited only by the claims set out below. Thus, the invention encompasses all alternate versions that fall literally or equivalently within the scope of these claims.

What is claimed is:

1. A method of manufacturing a decorative tile set of nonuniformly-shaped tiles for installation adjacent uniformly-shaped tiles, the tiles having opposing upper and lower surfaces bounded by interlocking edges, the method comprising:

a. for each tile within the tile set, defining a tile boundary at the upper surface of the tile, wherein the tiles within the tile set are adjacently situated at the tile boundaries;

b. providing a sacrificial bed having a planar upper bed surface;

C. cutting trenches in the sacrificial bed, the trenches defining areas on the upper bed surface which at least substantially correspond to the tile boundaries;

d. providing atop the sacrificial bed a workpiece from which the tiles within the tile set are to be cut;

e. cutting the workpiece along tile blank boundaries which are coincident with or outside the tile boundaries, thereby producing tile blanks;

f. cutting:

i. male interlocking structure on selected tile blanks, the male interlocking structure being defined in portions of these tile blanks within the tile blank boundaries and outside the tile boundaries, and ii. female interlocking structure on selected tile blanks, the female interlocking structure being defined in portions of these tile blanks within their tile blank boundaries and their tile boundaries;

wherein the cutting of the interlocking structure on each tile blank conforms the tile blank's upper surface to correspond to the tile boundaries therein.

2. The method of claim 1 wherein the cutting of the male and female interlocking structure is performed by a cutting tool which extends into the trenches of the sacrificial bed.

3. The method of claim 1 further comprising the step of installing the tile set simultaneously with the installation of the uniformly-shaped tiles, wherein at least some of the nonuniformly-shaped tiles within the tile set are in interlocking abutment with the uniformly-shaped tiles.

4. The method of claim 1 further comprising the step of installing the tile set within a field of previously installed uniformly-shaped tiles, the step further including the substeps of:

a. removing selected uniformly-shaped tiles, and b. inserting the tile set within the space previously occupied by the selected uniformly-shaped tiles, with at least some of the nonuniformly-shaped tiles within the tile set being in interlocking abutment with adjacent uniformly-shaped tiles.

5. The method of claim 1 further comprising the step of securing the upper surfaces of the tile blanks to abut the sacrificial bed during cutting of the male and female interlocking structure.

6. The method of claim 5 wherein the sacrificial bed provides a vacuum force to the upper surfaces of the tile blanks during cutting of the male and female interlocking structure.

7. The method of claim 6 wherein the cutting of the male and female interlocking structure is performed by a cutting tool which extends into the trenches of the sacrificial bed.

8. The method of claim 6 wherein the sacrificial bed is porous and is situated between the upper surfaces of the tile blanks and a machine bed associated with a cutting tool, and wherein the machine bed provides vacuum to the sacrificial bed.

9. The method of claim 1 wherein the upper surfaces of the tile blanks abut the sacrificial bed during cutting of the male and female interlocking structure.

10. The method of claim 9 wherein the cutting of the male and female interlocking structure is performed by a cutting tool which extends into the trenches of the sacrificial bed.

11. A method of manufacturing a decorative tile set of nonuniformly-shaped tiles for installation adjacent uniformly-shaped tiles, the tiles having opposing upper and lower surfaces bounded by interlocking edges, the method comprising:

a. for each tile within the tile set, defining a tile boundary at the upper surface of the tile, wherein the tiles within the tile set are adjacently situated at the tile boundaries;

b. providing a sacrificial bed having a planar upper bed surface;

c. cutting trenches in the sacrificial bed, the trenches defining areas on the upper bed surface which at least substantially correspond to the tile to boundaries;

d. providing atop the sacrificial bed a workpiece from which the tiles within the tile set are to be cut, the workpiece having an upper surface corresponding to the upper surfaces of the tiles in the tile set, and wherein the upper surface of the workpiece is situated in abutment with the sacrificial bed;

e. affixing the upper surface of the workpiece to the sacrificial bed;

f. cutting the workpiece to produce tile blanks having tile blank boundaries situated at or outside the tile boundaries;

g. cutting at least one of male interlocking structure and female interlocking structure in each tile blank, wherein the cutting of the interlocking structure on each tile blank conforms the tile blank's upper surface to correspond to the tile boundaries therein, wherein the cutting is performed by a cutting tool which extends into the trenches in the sacrificial bed during the cutting of the interlocking structure on each tile blank.

12. The method of claim 11 wherein the upper surface of the workpiece is affixed to the sacrificial bed by vacuum forces.

13. The method of claim 12 wherein the vacuum forces are provided by a machine bed associated with a cutting tool.

14. The method of claim 13 wherein the sacrificial bed is porous and transmits the vacuum forces from the machine bed to the upper surface of the workpiece.

15. A method of manufacturing a decorative tile set of nonuniformly-shaped tiles for installation adjacent uniformly-shaped tiles, the tiles having opposing upper and lower surfaces bounded by interlocking edges, the method comprising:

a. for each tile within the tile set:

i. defining a tile boundary at the upper surface of the tile, wherein the tiles within the tile set are adjacently situated at the tile boundaries;

ii. for each tile within the tile set, adding an offset region to the tile boundary at the upper surface of the tile in one or more directions parallel to the upper surface of the tile, thereby defining a tile blank boundary for each tile;

b. providing a sacrificial bed having a planar upper bed surface;

c. cutting trenches in the sacrificial bed, the trenches defining areas on the upper bed surface which at least substantially correspond to the tile boundaries;

d. providing atop the sacrificial bed a workpiece from which the tiles within the tile set are to be cut;

e. cutting the workpiece along paths corresponding to the tile blank boundaries, thereby producing tile blanks;

f. cutting:

i. male interlocking structure on selected tile blanks, the male interlocking structure being defined in portions of these tile blanks beneath their offset regions, and ii. female interlocking structure on selected tile blanks, the female interlocking structure being defined in portions of these tile blanks beneath their tile boundaries and their offset regions;

wherein the cutting of the interlocking structure on each tile blank removes the tile's offset region, thereby cutting the tile blank's upper surface to correspond to the tile boundaries therein.

16. The method of claim 15 wherein the cutting of the male and female interlocking structure is performed by a cutting tool which extends into the trenches of the sacrificial bed.

17. The method of claim 15 further comprising the step of installing the tile set simultaneously with the installation of the uniformly-shaped tiles, wherein at least some of the nonuniformly-shaped tiles within the tile set are in interlocking abutment with the uniformly-shaped tiles.

18. The method of claim 15 further comprising the step of installing the tile set within a field of previously installed uniformly-shaped tiles, the step further including the substeps of:

a. removing selected uniformly-shaped tiles, and b. inserting the tile set within the space previously occupied by the selected uniformly-shaped tiles, with at least some of the nonuniformly-shaped tiles within the tile set being in interlocking abutment with adjacent uniformly-shaped tiles.

19. The method of claim 15 wherein the upper surfaces of the tile blanks abut the sacrificial bed during cutting of the male and female interlocking structure.

20. The method of claim 19 wherein the cutting of the male and female interlocking structure is performed by a cutting tool which extends into the trenches of the sacrificial bed.

* * * * *